US007356858B2

(12) United States Patent
Summers

(10) Patent No.: US 7,356,858 B2
(45) Date of Patent: Apr. 15, 2008

(54) SIT TO STAND SUPPORT APPARATUS

(76) Inventor: Patrick D. Summers, 97 Richmond Dr., Manchester, CT (US) 06040

( * ) Notice: Subject to any disclaimer, the term of this patent is extended or adjusted under 35 U.S.C. 154(b) by 357 days.

(21) Appl. No.: 11/153,756

(22) Filed: Jun. 14, 2005

(65) Prior Publication Data

US 2005/0283906 A1 Dec. 29, 2005

Related U.S. Application Data

(60) Provisional application No. 60/579,293, filed on Jun. 14, 2004.

(51) Int. Cl.
*A61G 7/10* (2006.01)

(52) U.S. Cl. ..... 5/83.1; 5/86.1; 5/87.1; 5/89.1

(58) Field of Classification Search ..... 5/83.1, 5/85.1, 86.1, 87.1, 89.1, 81.1 R
See application file for complete search history.

(56) References Cited

U.S. PATENT DOCUMENTS

| | | | | | |
|---|---|---|---|---|---|
| 1,876,832 | A | * | 9/1932 | Bancroft | 5/89.1 |
| 1,878,785 | A | * | 9/1932 | Leavitt | 5/86.1 |
| 3,137,011 | A | * | 6/1964 | Fischer | 5/86.1 |
| 3,222,029 | A | * | 12/1965 | Hildemann | 254/8 R |
| 3,623,169 | A | * | 11/1971 | James | 5/87.1 |
| 3,694,829 | A | * | 10/1972 | Bakker | 5/87.1 |
| 3,732,584 | A | * | 5/1973 | James | 5/87.1 |
| 3,877,421 | A | * | 4/1975 | Brown | 601/23 |
| 4,117,561 | A | * | 10/1978 | Zamotin | 5/83.1 |
| 4,157,593 | A | * | 6/1979 | Kristensson | 5/87.1 |
| 4,409,696 | A | * | 10/1983 | Bakker | 5/87.1 |
| 4,435,863 | A | * | 3/1984 | Lerich | 5/87.1 |
| 4,484,366 | A | * | 11/1984 | Koontz | 5/83.1 |
| 4,569,094 | A | * | 2/1986 | Hart et al. | 5/87.1 |
| 4,656,679 | A | * | 4/1987 | James | 5/87.1 |
| 4,680,819 | A | * | 7/1987 | James | 5/83.1 |
| 4,682,377 | A | * | 7/1987 | Reich | 5/83.1 |
| 4,703,523 | A | * | 11/1987 | James | 5/83.1 |
| 4,918,771 | A | * | 4/1990 | James | 5/87.1 |
| 4,946,421 | A | | 8/1990 | Kerley et al. | 464/56 |

(Continued)

FOREIGN PATENT DOCUMENTS

GB 2140773 A * 12/1984

(Continued)

OTHER PUBLICATIONS

LITE GAIT by Mobility Research, 5 pages.

(Continued)

*Primary Examiner*—Robert G. Santos
(74) *Attorney, Agent, or Firm*—McCormick, Paulding & Huber LLP

(57) ABSTRACT

A rolling chassis supports dual lifting beams pivotably mounted on adjustable supporting pins. The beams are pivoted by rollers raised by dual driving piers. Each beam carried a pair of blocks for a rope running from a locking system on the chassis to one side of an upper harness, and another pair of blocks for a rope running from a locking system on the chassis to one side of a lower harness. A retractable knee pad assists lifting a patient from sitting to standing position as the beams pivot and retract the cables.

18 Claims, 7 Drawing Sheets

U.S. PATENT DOCUMENTS

| | | | | |
|---|---|---|---|---|
| 5,001,789 | A * | 3/1991 | Schoenberger | 5/87.1 |
| 5,022,106 | A * | 6/1991 | Richards | 5/86.1 |
| 5,174,590 | A | 12/1992 | Kerley et al. | 280/105 |
| 5,189,741 | A * | 3/1993 | Beardmore | 5/86.1 |
| 5,309,584 | A * | 5/1994 | Parker | 5/87.1 |
| 5,369,821 | A * | 12/1994 | Richards et al. | 5/86.1 |
| 5,412,820 | A * | 5/1995 | Richards | 5/86.1 |
| 5,530,976 | A * | 7/1996 | Horcher | 5/89.1 |
| 5,644,805 | A * | 7/1997 | Horcher | 5/86.1 |
| 5,878,450 | A * | 3/1999 | Bouhuijs | 5/86.1 |
| 6,134,725 | A * | 10/2000 | Bouhuijs | 5/86.1 |
| 6,175,973 | B1 * | 1/2001 | Hakamiun et al. | 5/89.1 |
| 6,389,619 | B1 * | 5/2002 | Dunn | 5/86.1 |
| 6,449,785 | B1 * | 9/2002 | Liljedahl | 5/89.1 |
| 6,568,002 | B1 * | 5/2003 | Liljedahl | 5/86.1 |
| 6,581,222 | B1 * | 6/2003 | Liljedahl | 5/89.1 |
| 6,806,430 | B2 * | 10/2004 | Downing | 177/144 |
| 2001/0027574 | A1 * | 10/2001 | Bouhuys | 5/86.1 |
| 2005/0217025 | A1 * | 10/2005 | Barattia | 5/86.1 |
| 2005/0268397 | A1 * | 12/2005 | Nativ | 5/86.1 |
| 2005/0283906 | A1 * | 12/2005 | Summers | 5/86.1 |

FOREIGN PATENT DOCUMENTS

GB 2177063 A * 1/1987

OTHER PUBLICATIONS

Therapeutic Products Directorate: TPD-Web, Aug. 6, 2003.

Nurse Safety: Investments in Equipment, Training Help Prevent Back Injuries, NUREZONE.com, pp. 1-3, Mar. 13, 2004.

Total Patient Lift, p. 1.

Solutions for Moving Bariatric Patients, Barrier Free Lifts, p. 1.

Reliable and Economical Series of SUREHANDS portables, Lift & Care Systems, Inc. p . 1.

Steady Aid and Ultra Lift 2500X by T.H.E. Medical, Professional Patient Care Products, 2 pages.

Hoyer Power Lifts by Total Home Comforts, Inc., 1 page.

Ergolift 600 by BHM Medical, Inc., 3 pages.

The Mobile Lift by Just-Patient-Lifters.com, 5 pages.

Bari Tilt Table/Gait System by NewCareThrapies.com, 2 pages.

Sit-to-Stand by Barrier Free Lifts, Inc., 10 pages, Aug. 2003.

Vander-Lift 450 by Vancare, Inc. 8 pages.

S.A.M. (Secure Ambulation Module) by Enduro Slide Presentation, 17 pages.

NASA Goddard Space Fligth Center Technology Aids Physical Therapy, Assistive Technology Nomination Paper for the 9th International Conference on Computers Helping People with Special Needs (ICCHP), submitted by Goddard Space Flight Center Office of Technology Transfer, 8 pages, Exhibit C—photographs and graphs, 18 pages.

* cited by examiner

SIT TO STAND SUPPORT APPARATUS

CROSS REFERENCE TO RELATED APPLICATION

This application claims the priority of pending provisional application Ser. No. 60/579,293 filed Jun. 14, 2004.

TECHNICAL FIELD

This invention relates to ambulation assistance devices and, more particularly, to an apparatus that assists a person moving between sitting and standing positions.

BACKGROUND OF THE INVENTION

In the past, patients needing assistance to reach standing positions had to depend upon human or prior art mechanical support. If supported solely by nursing or therapy personnel, there is a higher risk of injury for both the patient and the assisting personnel. Patients could lose support lifting themselves or being lifted and sustain a fall. Nursing or therapy personnel could sustain back or other muscle injuries while preventing the patient fall or while in the act of lifting and moving the patient, especially when a patient is an obese or morbidly obese person (morbidly obese being at least two times the recommended weight for a given height).

Prior art mechanical devices may also at times require a level of assistance from the patient themselves to accomplish the standing task. Prior art mechanical devices also do not address the true nature of motion required to move from a sitting to a standing position. In fact, it is complex. To mirror the same movement required to achieve an independent sit to stand, the shoulders must lean forward out over the knees placing the center of mass over the feet. The feet are then prepared to support the body weight in line as the torso is raised to an erect posture.

Prior art devices either lifted by the upper torso only, which can possibly overload the delicate upper body structure (most commonly the axillary [armpit] area and specifically the shoulder joints and tendons), or by the upper torso and hips, which when employed at the same angle and speed during the lift tends to keep the patients in a crouching or semi-crouching position.

Devices that facilitate a patient moving from sitting and standing positions typically utilize one actuator that raises a lift element (e.g., a boom). One end of the boom is fixed at an axis point and when raised describes an arc that exists in the vertical plane. The actuators are either electrical or mechanical. The manual type typically employs a lever or piston arrangement. Such devices operate in a manner that is similar to the way in which a hoist lifts an engine out of an automobile engine bay. While raising the boom in a vertical arc, the shoulders and trunk are pulled and lifted upward bringing the person from a sitting to a semi-crouching position. As the boom completes its arc the pulling motion shifts from primarily vertical to primarily forward to raise the patient from a crouching position to an erect posture.

Most of the prior art devices are sufficiently stable to allow a smaller or average size person to be lifted from a sit to a stand position with the assistance of nursing or therapy personnel. However, instabilities inherent in lifting patients who are large or obese and those who are unable to maintain their own balance, may cause lateral forces to be exerted on the boom as it moves through its vertical arc. Such lateral forces may tend to cause a shifting of the patient's center of mass, which in turn may cause the undesirable side loading of the actuators. Such side loading may contribute to the instability of the device and may compromise the structural integrity of the actuators.

What is needed is an apparatus that allows a patient of any size, including obese and morbidly obese, to securely and safely move between sitting and standing positions with a minimum of risk of injury to themselves or to those who are assisting them; and that can operate with minimal risk of equipment failure while supporting any patient.

SUMMARY OF THE INVENTION

Briefly stated, the invention comprises a sit to stand support apparatus for raising a patient from a sitting to an upright position, having a rollable chassis, a pair of vertically extending support piers disposed on top of the chassis, a pair of vertically extendable driving piers disposed on top of the chassis having roller platforms thereon, means for selectively raising and lowering the roller platforms, a boom comprising a pair of beams each pivotably mounted at one end thereof on the supporting piers and extending beyond said driving piers to terminate in lifting end, each beam having a roller mounted thereon arranged to roll on the roller platforms when the roller platforms are raised and lowered so as to raise and lower the lifting ends, a first block and tackle device having a first block disposed on said lifting end of the beam and having a first cable with a first cable end, a second block and tackle device having a second block disposed on said lifting end of the beam and having a second cable with a second cable end, and an upper harness connectable to the first cable end and adapted to support the axillary area of said patient, and a lower harness connectable to the second cable end and adapted to support the pelvis of the patient.

Preferably the apparatus also includes a kneepad disposed on said chassis arranged to engage the knees of said patient to provide leverage to move from a sitting to a standing position. wherein the kneepad is movable to and from said chassis to enable the patient to ambulate. Preferably also the apparatus includes a foot tray disposed to enable the patient to place its feet on the tray when the patient is lifted and positioned on and against the sit to stand apparatus, wherein the foot tray is slidable into the chassis to enable the patient to ambulate with the rollable chassis. Preferably also the block and tackle devices include a cable locking system rotatably mounted on the chassis to keep the cable aligned as the lifting end of the beam is raised and lowered.

BRIEF DESCRIPTION OF THE DRAWINGS

The invention would be better understood by reference to the following description, taken in connection with the accompanying drawings, in which.

DETAILED DESCRIPTION OF THE PREFERRED EMBODIMENTS

Figure 1:
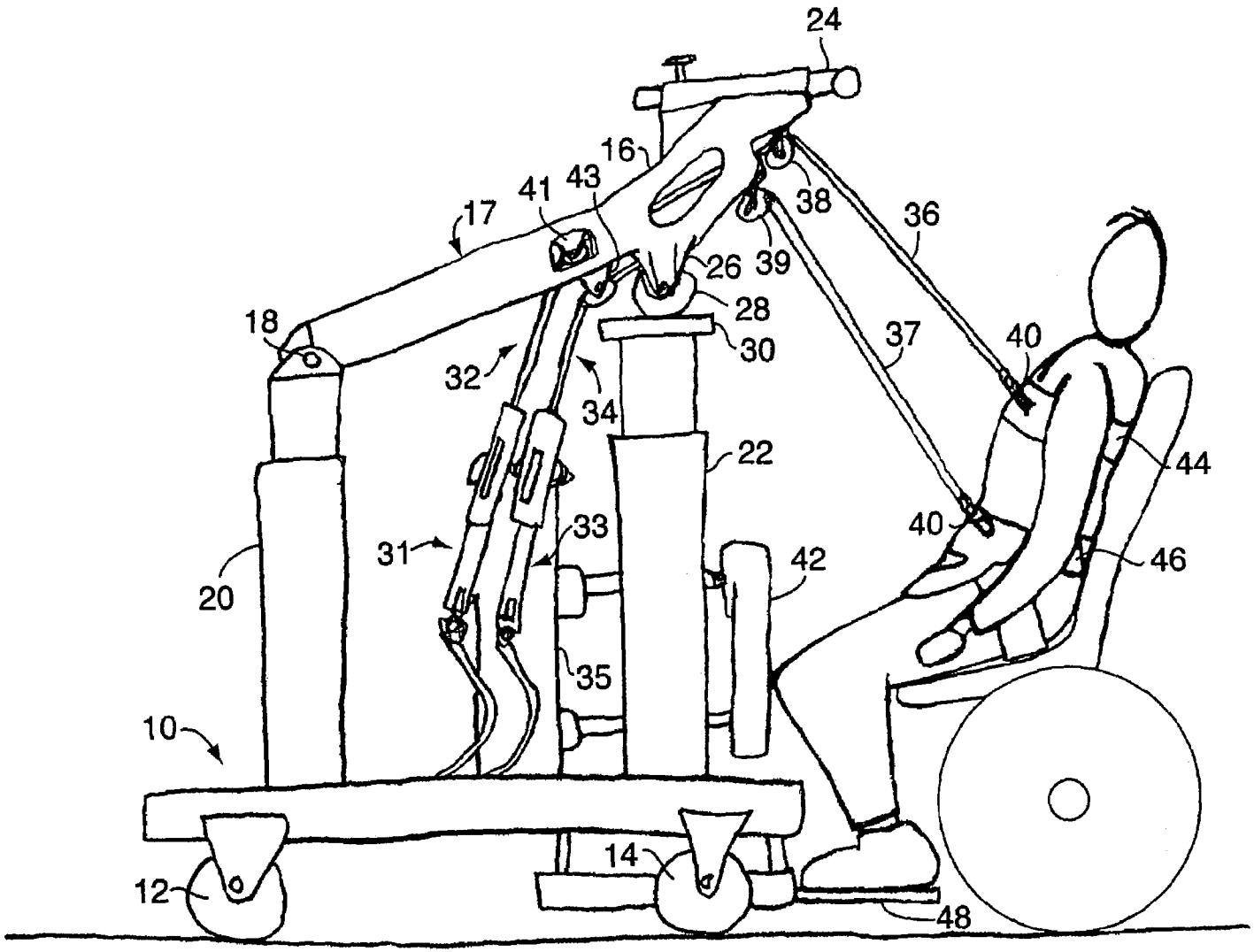
FIG. 1 is a simplified side elevation drawing of the sit to stand support apparatus attached to a patient in a sitting position.

The contents of U.S. Pat. No. 5,174,590 and provisional patent application 60/579,293 (docket number 5196-002, Enduro Medical Technology Sit to Stand Support Apparatus), are incorporated herein by reference in their entireties.

The present invention is a chassis structure having a boom that comprises dual parallel beams that are simultaneously rotated about pivot points by substantially vertical upright dual driving piers. The beams are pivotally supported at dual support piers, the support piers being telescopically adjustable in height to allow for the overall height adjustment of the apparatus. The driving piers are telescopingly extendable to rotate the beams about the pivot points. The chassis is positioned such that the patient is at the non-pivoting ends of the beams when the patient is in a sitting position. Ropes, cables, chains, or wires are fixed to the chassis and extend over support surfaces at or near the free (non-pivoting) ends of the beams to connect to a harness worn by the patient. The knees of the patient are placed against a knee pad connected to the chassis. Actuators enable the driving piers to controllably extend in the vertical direction at the desire of the patient or the therapist, thereby pivoting the beams, so as to draw the cables and harness toward the apparatus, thus pivoting the patient about the point at which his knees contact the kneepad, and lifting the patient from a sitting position to a standing position. A horizontal actuator may provide for the adjustment of the width of the chassis to ensure that the loading on the towers is minimized.

Such an apparatus can be used by patients that require assistance in moving between sitting and standing positions. The apparatus is particularly useful for patients having degenerative conditions (e.g., arthritis, cerebral palsy, MS, or ALS), suffering from balance problems attributed to strokes or Parkinson's disease, or recovering from acute injuries (e.g., brain injuries, spinal cord injuries, hip or knee replacement surgeries, and ACL/PCL). The apparatus can still further by used by persons suffering from conditions of obesity.

The apparatus enables a user to move from a sitting position to an upright position while controlling the weight exerted on the user's legs and allowing the user to maintain an upright position. In any application, the apparatus enables a user to assume a vertical orientation in a safe and stable manner.

One advantage of the apparatus is that it provides support and stability to the pelvis of the user as the user assumes a vertical orientation in preparation for undergoing walking therapy or any activity that requires the user to be in a standing position. Use of the apparatus, particularly in conjunction with an attached harness, facilitates a comfortable positioning of the trunk and shoulders while coming to a standing position or while sitting down.

Another advantage is the risk of injuries from falling are reduced. Because the user is not required to bear his own weight on his arms, the upper extremities are not taxed while coming to standing or sitting positions.

Another advantage is the number of nursing or therapy personnel required for moving a patient between sitting and standing positions is reduced. One nursing or therapy personnel can bring the user to a standing position at the module, thereby increasing staff efficiency. Furthermore, because the harness can be pre-attached to the user and the user can be brought to a standing position at the module by adjusting the height of the towers, the risk of back injury for a therapist is reduced.

The apparatus is a user-friendly, commercially viable product having a harness and electronic actuators mounted on a frame or chassis. With its unique harness the apparatus allows the user to come to a standing position with assistance from a therapist or care giver. The apparatus also allows the user to move from a standing position to a sitting position. Preferably the apparatus can accommodate users between about 4 feet and about 7 feet tall and up to about 1000 pounds in weight.

Figure 2:
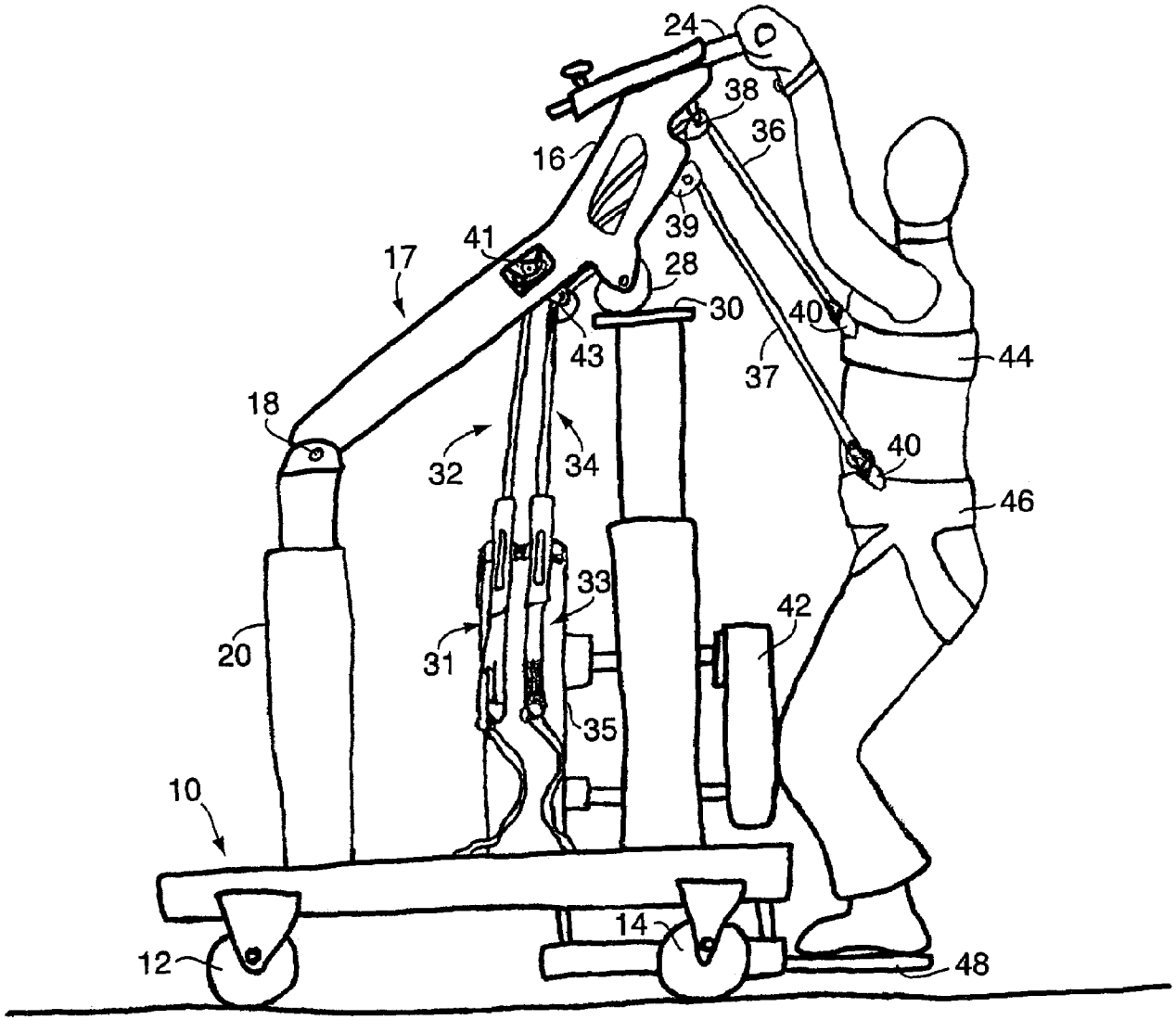
FIG. 2 is the same sit to stand support apparatus after having elevated the patient to a standing position.

The apparatus, as is shown in FIGS. 1 and 2, comprises a chassis 10 that is capable of being rolled over a ground surface on wheels 12, 14. As is used herein, when the apparatus is positioned so as to roll across the ground surface, the term "bottom" when used in reference to the chassis refers to the surfaces of the chassis that face the ground surface, the term "top" when used in reference to the chassis refers to the surfaces of the chassis that face away from the ground surface, the term "front" refers to an end of the chassis at which a boom structure is pivotally supported, and the term "back" refers to an end of the chassis that is opposite the front end and at which a patient engages the apparatus.

Two laterally spaced beams, one of which is seen at 16, that pivot in unison and function as a boom 17 to lift a patient are pivotably mounted toward the front of the chassis. The beams are mounted in pivot pins 18 and supported at their fulcrum ends by a pair of respective supporting piers 20 that are telescopically adjustable in vertical directions from the top of the chassis. The vertical adjustability of the supporting piers allows for the adjustment of the height of the apparatus, thereby enabling patients to be lifted from and lowered to chairs or beds of different heights (or from the ground). The beams are also supported at a point along the length thereof by a pair of laterally spaced respective driving piers 22, which likewise extend vertically from the top of the chassis. Handles 24 on the free ends of each beam enable a patient utilizing the apparatus to assist the apparatus in lifting or lowering the patient to or from the standing position or to give the patient a feeling of additional security.

The beams are pivoted by the extension of the driving piers. The upper ends of the driving piers are preferably connected by a cross-bar (not shown) or similar member. The extendability of the driving piers may be effected by telescoping actions actuated by mechanical, hydraulic, or pneumatic means. Preferably, the actuation of the extendable action is controlled by an electric motor that is controllable by the user or the therapist.

Roller assemblies 26 are fixedly or movably mounted to each of the beams. Each roller assembly contains at least one roller 28 that contacts a corresponding rolling platform 30 on top of each driving pier. The rollers are arranged such that upon extension of the driving piers, the beams pivot about their fulcrum pivot pins 18 at the supporting piers 20 and the rollers 28 supportingly roll along the roller platforms 30 of each driving pier. Preferably, the rollers are fabricated from a urethane or an elastomeric material to maximize their ability to resist wear over extended periods of use. A boot, shroud, or similar flexible member is preferably positioned around each roller assembly, the point of connection of the roller assembly to the beam, and rolling surface of the driving pier to minimize the possibility that the patient or therapist can intentionally or inadvertently obstruct or otherwise interfere with the engagement of the roller assembly and the rolling surface. As shown, the flexible member is a stretchable cloth member.

The design of the beam roller system allows for the load of the beam to be directed in a virtual downward vertical motion which reduces almost all side loading. This unique design eliminates yoke and joint fatigue cycling inherent to other designs while increasing load carrying capabilities and producing a smoother motion.

A series of marine-type block and tackle devices shown generally at 32, 34 are incorporated into the apparatus to lift and pull or lower the patient to or from a standing position. Each device is mounted on the chassis. Referring to device 32, rope, wire, chain, or cable 36 is threaded through each device, up to each beam, over a fixed block 41 to the free lifting end of each beam, over a swivel block 38, and then attached to an upper harness 44. Similarly, in block and tackle device 34, a rope or cable 37 is threaded over a fixed block 43, over a swivel block 39 mounted on the lifting end of beam 16, and attached to a lower harness 46. Preferably, rope is used. The hoisting ends of the rope or cable are held in rotatable locking systems 31, 33 supported on a stationary pier 35.

A duplicate system of block and tackle devices (not shown) is laterally spaced on the other side of chassis 10. The marine-type block and tackle devices are configured to provide for the quick adjustment of the rope tension as the user is raised between sitting and standing positions. Pulleys, rollers, or fixed elements having radiused surfaces allow for the support of the rope (or other material) while minimizing friction generated by movement of the rope against the support surfaces. Connection mechanisms are attached to the ends of the ropes for connecting the ropes to rings or other receiving devices on the harness. Although the connection mechanisms are shown as being carabiners 40, other devices may be utilized.

A knee pad 42 mounted on the chassis provides a surface against which the user's knees can be placed to provide leverage for lifting the user.

The harness, worn by the user, may be of a one piece or two-piece design but either addresses the support of the body in the same two areas.

First, the upper harness 44 or upper part of the harness spans and partially supports under the axillary (armpit) area. Although designed as a companion to the lower harness or lower part of the harness, the upper part of the harness can function without support of the lower part of the harness for a brief time while toileting and/or changing clothes. The upper part of the harness is comprised of a fabric foundation, stuffed with foam, to which is sewn nylon webbing to create pockets. These pockets carry heavy duty webbing belts that are used to position the harness and support the upper body. Metal or plastic adjusters are used in conjunction with the webbing belts to size the harness to each individual. Carabiners are used to provide a quick strong and durable connection between the harness and the Sit to Stand apparatus.

Second, the lower harness 46 or lower part of the harness supports the hips when lifting to a stand and prevents sliding up by use of straps which wrap around the legs and fasten securely. The lower part of the harness is comprised of a fabric foundation to which is sewn nylon webbing to create pockets. These pockets carry heavy duty webbing belts that are used to position the harness and to support the lower body. Metal or plastic quick release buckles are used as fasteners and carabiners provide a quick strong and durable connection between the harness and the apparatus.

The upper and lower part of the harness can be easily applied to the user while the user is lying in a supine (face-up) position and are then connected to ropes by carabiners. Various sizes and configurations of the harness may be available to accommodate users of different sizes and needs.

For a user to engage the apparatus and be lifted, the support piers and the driving piers are adjusted to a suitable height depending on where the user is to be lifted from. For example, if the user is to be lifted from a supine position on the floor, the height of the apparatus may need to be minimized. If, on the other hand, the user is lifted from a chair to a standing position, as shown in FIGS. 1 and 2, the height of the apparatus may need to be increased accordingly. The driving piers are then retracted as in FIG. 1 and the harness can be connected to the ropes. The user's legs are bent so that the knees are placed against the kneepad. The driving piers are then extended, as shown in FIG. 2, and the user is pivoted about the point at which his knees engage the kneepad, thereby raising the center of mass of the user and bringing the harness and the user to an upright position. The user can provide some degree of effort (if desired) by grasping the handles and pulling himself up. This enables joint replacement patients to have full ranges of motion with only a selected amount of weight placed on the joints themselves, thereby easing the pain endured by the patient.

The apparatus further includes a trunk harness (not shown). A full upper trunk harness may be used with the apparatus to provide additional stability to patients with severe balance issues. Furthermore, the chassis or the support piers may further include attachments for various accessories such as an oxygen bottle, an IV bag, vent, urinary drainage bags, etc. Other accessories such as time distance readout capabilities or a load cell capable of providing a weight readout may be attached to the apparatus.

Figure 3:
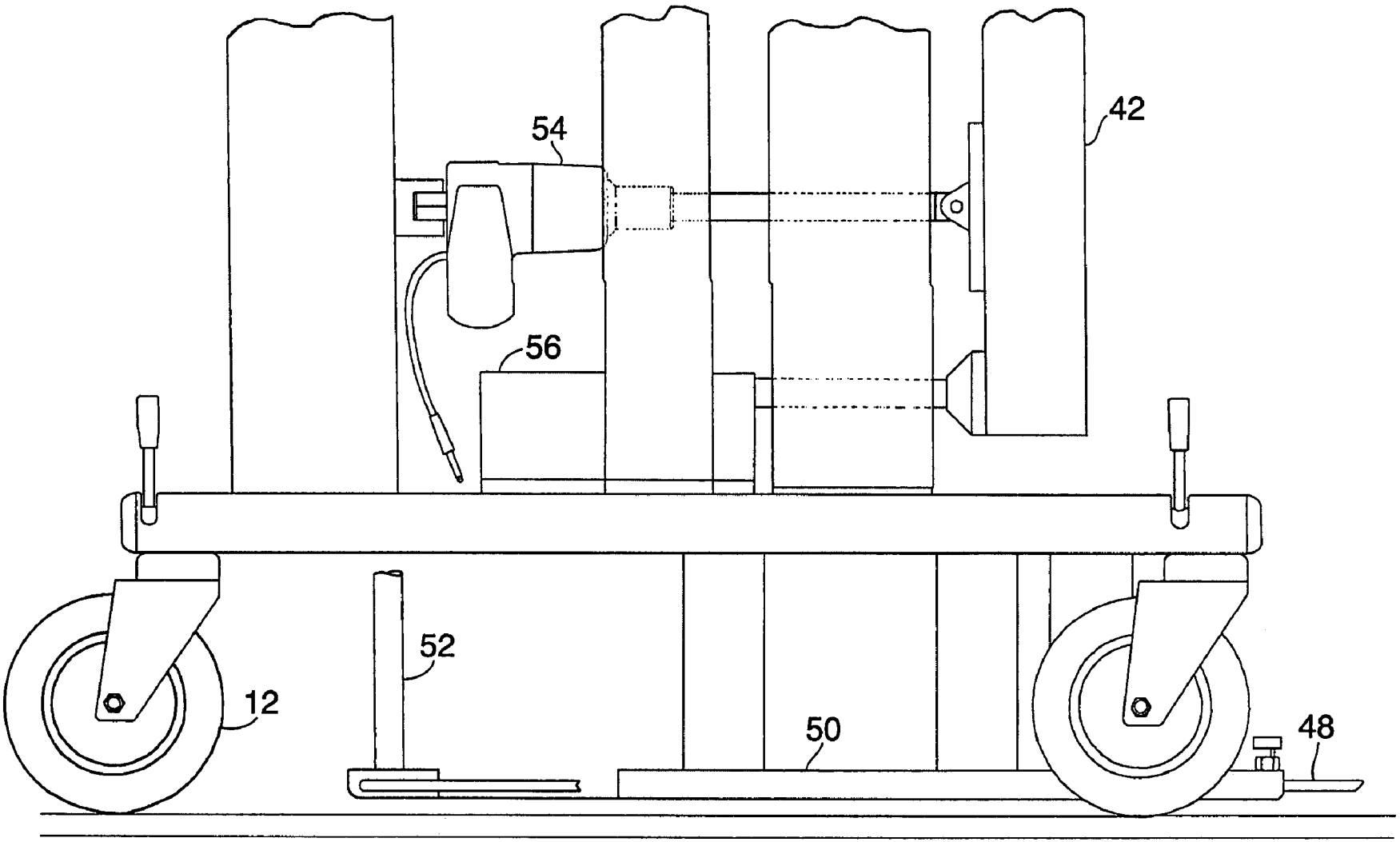
FIG. 3 is a fragmentary side elevation drawing showing the details of the rollable chassis of the apparatus with knee pad and foot tray.

Referring now to the detailed view of FIG. 3, another feature of the present invention is a foot tray or plate 48 which can be mounted in a slidable manner in carrier 50 at the bottom of the apparatus and advanced or retracted using the manual actuator 52. This enables the patient to place his or her feet on the tray when the patient is lifted and positioned on and against the sit to stand apparatus. The patient can then be either wheeled by hand or with a motorized assist about the room or hallway. This is especially useful for very large patients and for accomplishing very small accurate maneuver.

Note also that the foot tray may be configured to be two separate plates which can be oriented in a desired vertical angle relative to the floor, either substantially horizontal or with some variation thereof. This is especially useful for those patients who have joint mobility problems.

The movable knee pad 42 can be adjusted vertically as well as horizontally in certain embodiments depending upon the application. The adjustable knee pad can be moved forward or pivoted using electrically driven actuator 54, stabilized by guide 56, to engage and enable the patient to move from a sitting to a standing position and then be retracted away from the patient in towards the center of the apparatus to enable the patient to ambulate for physical therapy purposes or for movement of the apparatus itself with the patient attached.

Figure 4:
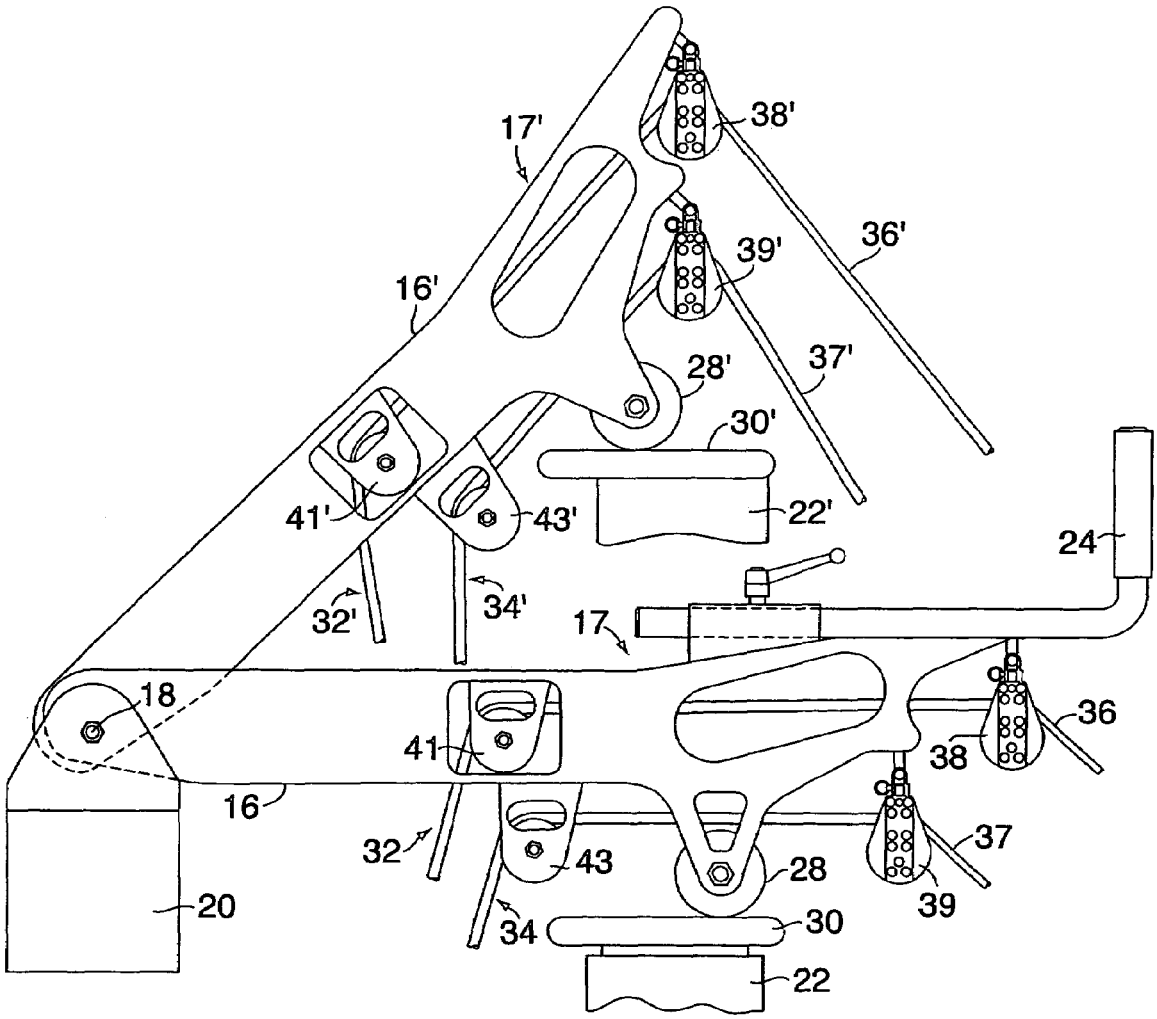
FIG. 4 is a fragmentary side elevation drawing illustrating the pivotable lifting beam in a lowered position and in a raised position shown in dotted lines, together with portions of a block and tackle device.

Portions of the boom 17 consisting of dual beams are seen in the detailed view of FIG. 4. Beam 16 and block and tackle devices 32, 34 are seen supported by roller 28 on roller platform 30 of driving pier 20. A duplicate beam (not shown) is laterally spaced from it and actuated by a duplicate driving pier (not shown). The following description of beam 16 and block and tackle devices 32, 34 applies equally to the equivalent duplicate structure laterally spaced from it on the chassis.

Beam 16 is illustrated in a lowered position. The swivel block 38 is attached to the outermost end of beam 16 guiding cable 36 of block and tackle device 32 to the upper chest harness 44 (not shown). A fixed block 41 disposed between pivot pin 18 and roller 28 guides the cable 36 down to a cable locking system to be described.

In similar manner, the swivel block 39 attached to the outermost end of beam 16 guides rope or cable 37 to the lower harness 46 (not shown). A fixed block 43 disposed between pivot pin 18 and roller 28 guides the other end of cable 37 to a cable locking system to be described.

Beam 16 and associated block and tackle devices 32, 34 are shown in dotted lines as beam 16' in a raised position, having been raised by platform 30' on top of driving pier 20', this movement being facilitated by roller 28'. The new positions of the block and tackle devices 32, 34 and associated blocks are designated with the same reference numbers, using prime superscripts, as 32' and 34'.

As boom 17 is raised to the position shown as 17', the ropes 36, 37 attached to upper harness 44 and lower harness 46 respectively simultaneously raise and pull the harnesses and patient toward the chassis until they reach the positions shown at 36', 37'. The relative movement between the two ropes 36 and 37 is a complicated function of the relative distances of the fixed blocks 41, 43 to the pivot pin 18, the relative distances of the swivel blocks 38, 39 to pivot pin 18, and the lift angle of boom 17.

With regard to the main boom apparatus, the location of block 38 is at the far or distal end of the boom closest to the patient and the other block 39 is mounted inboard and allows for a pull to lift ratio which is approximately one to one. That is, the amount of pulling and lifting is substantially the same.

Note that the outermost pulley rope 36 will be attached to the chest whereas the inner one 37 will be attached to the pelvic lift harness.

Another aspect of the present invention is the harness system used in the preferred embodiment. The harness system comprises two separate devices, one is an upper chest harness 44, which attaches underneath the arms, and comprises substantially a padded strap. The second is a pelvic harness 46 which includes a belt and an attached bottom strap which is meant to straddle the lower buttocks area. There are also two straps across the legs which aid in maintaining the position of the belt and bottom strap in relation to one another.

In operation, there is a clip, typically a carabiner type or D-ring 40, which is positioned adjacent the hip straddling the belt and bottom strap on either side of the patient. The appropriate rope or cable is affixed to the patient while the patient is in a sitting position. This allows the patient to sit and the device to be positioned without requiring undo awkward movements of the patient relative to the sit and stand lift apparatus.

Similarly, the upper chest strap is also adapted to receive equivalent D-ring or apparatus with an appropriate clip or hook to securely engage the rope or cable to the patient. Again all this is accomplished while the patient is in a sitting position. The slack is taken out of the cables or rope ensuring that the patient is properly positioned relative to the apparatus and that the harness is as well.

Twin actuators in parallel reduce loading allowing for real 4 point harness system which creates upper torso and pelvic control reducing swaying moment allowing for secure ergonomic lifting. Also it mimics pelvic motion while standing for ambulation and creates a true redundant 4 point system for maximum safety.

Figure 5:
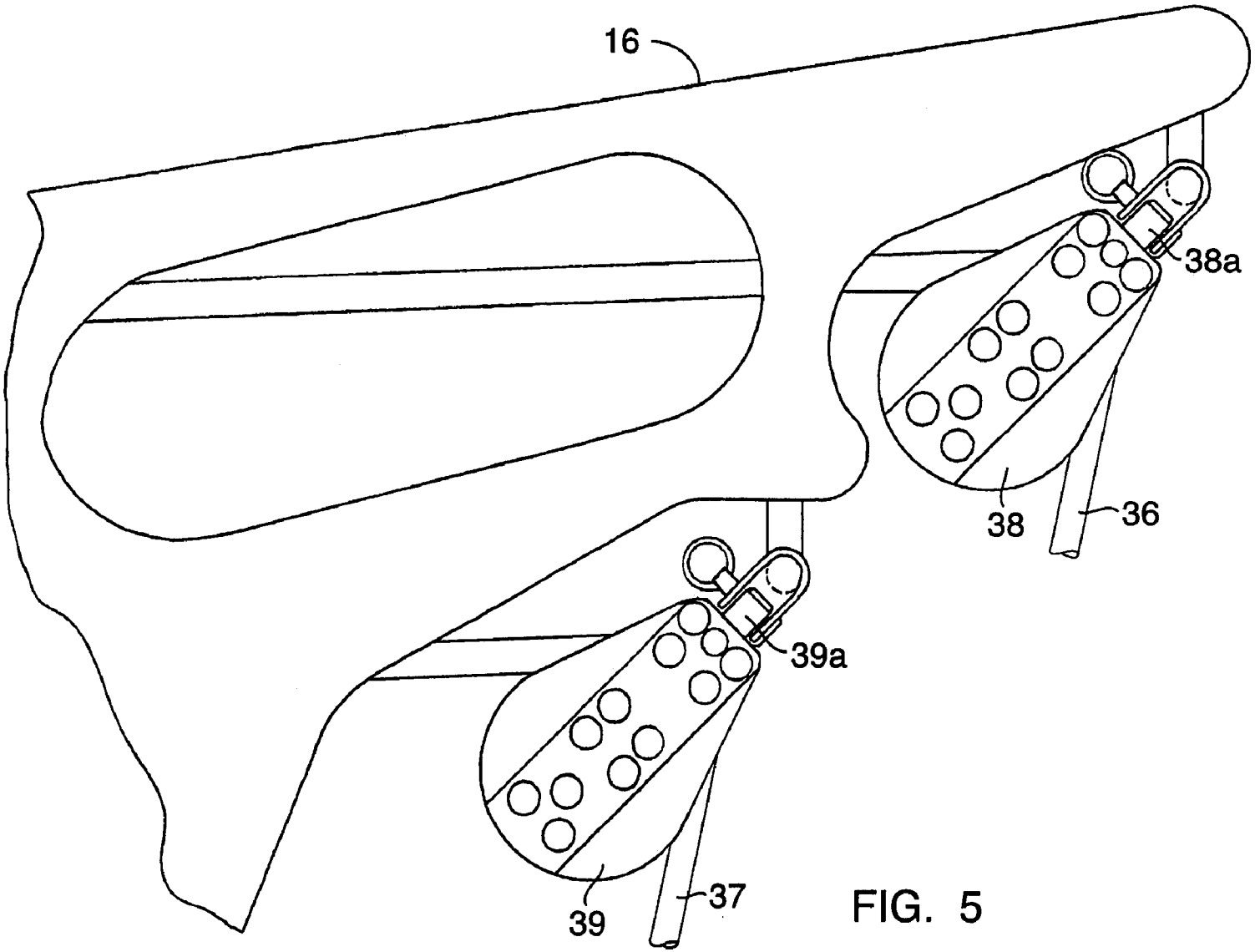
FIG. 5 is an enlarged elevation view of the lifting end of the pivotable beam shown in FIG. 4.

The swivel pulley system at the lifting end of beams 16, comprising swivel blocks 38 and 39, that may swivel on their respective swivel pins 38*a* and 39*a*, allows for interior and exterior body width extension and contraction to accommodate different body widths without pinching or severe loading. This is illustrated in the enlarged view of FIG. 5. Due to the pulling motion of the pulley system, the beam length is much shorter than a conventional system as it relates to the extension of the beam past the driving pier creating a stronger beam and more lifting capability while increasing stability by moving the center of gravity further to the rear reducing counterweight issues.

Figure 6:
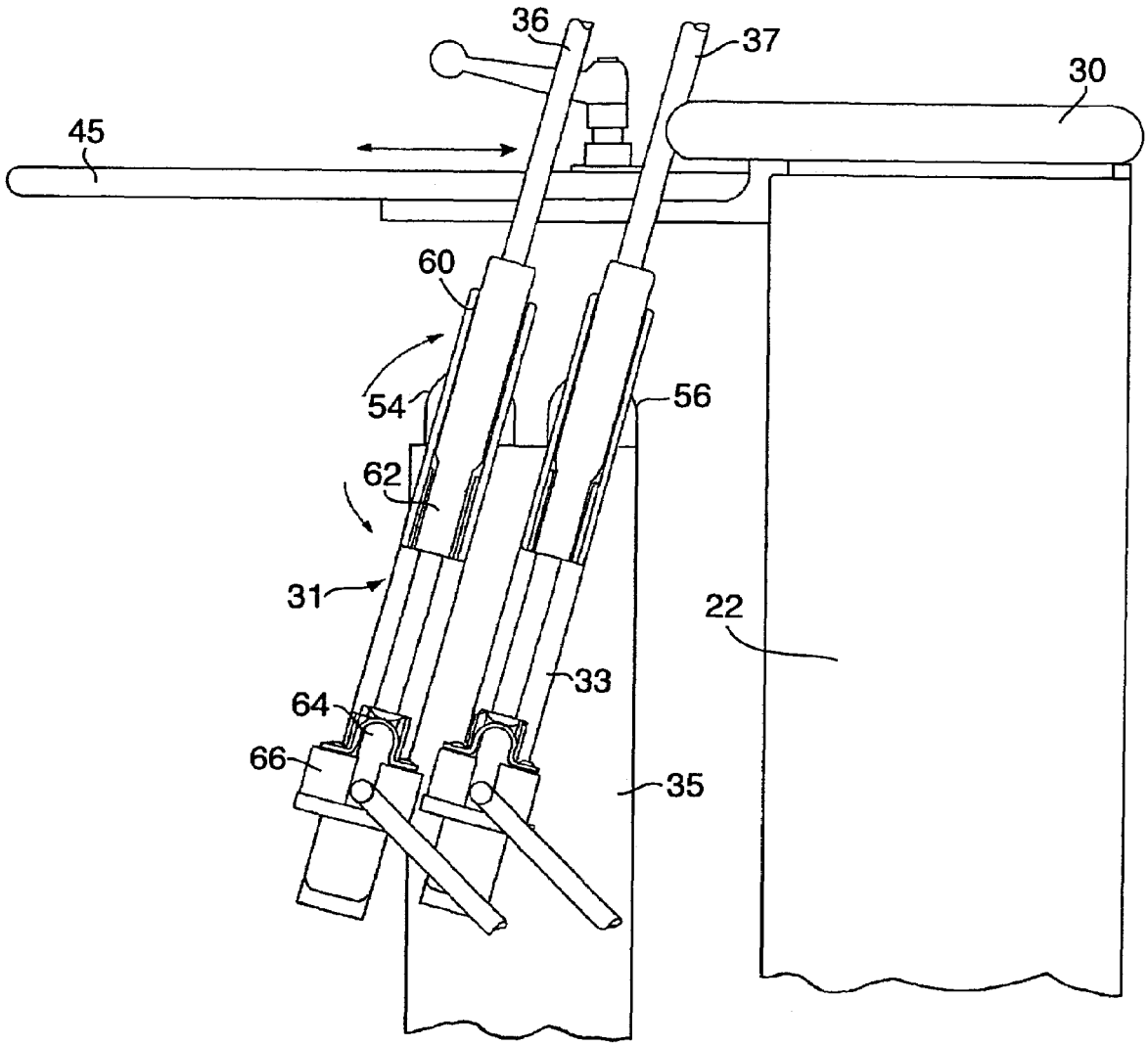
FIG. 6 is a side elevation view showing the rotatable cable lock and cleats of two block and tackle devices on one side of the apparatus.

With reference now to FIG. 6, there is also shown a sliding tray 45 which is located in the upper portion of the apparatus. The tray is in a substantially horizontal position and is accessible by the patient once he or she is in a standing position. The tray is useful for occupational therapy as well as physical therapy and can be slid towards and away from the patient as is desired.

The sliding tray 45 is fixed between the vertical actuator columns 22 so as to move up and down in unison with the columns horizontal to the ground but also adjusting in the anterior and posterior directions provides upper anterior trunk control in a standing position, surface area for O.T. therapy, and an area for mounting or placing a ventilator, etc.

Figure 7:
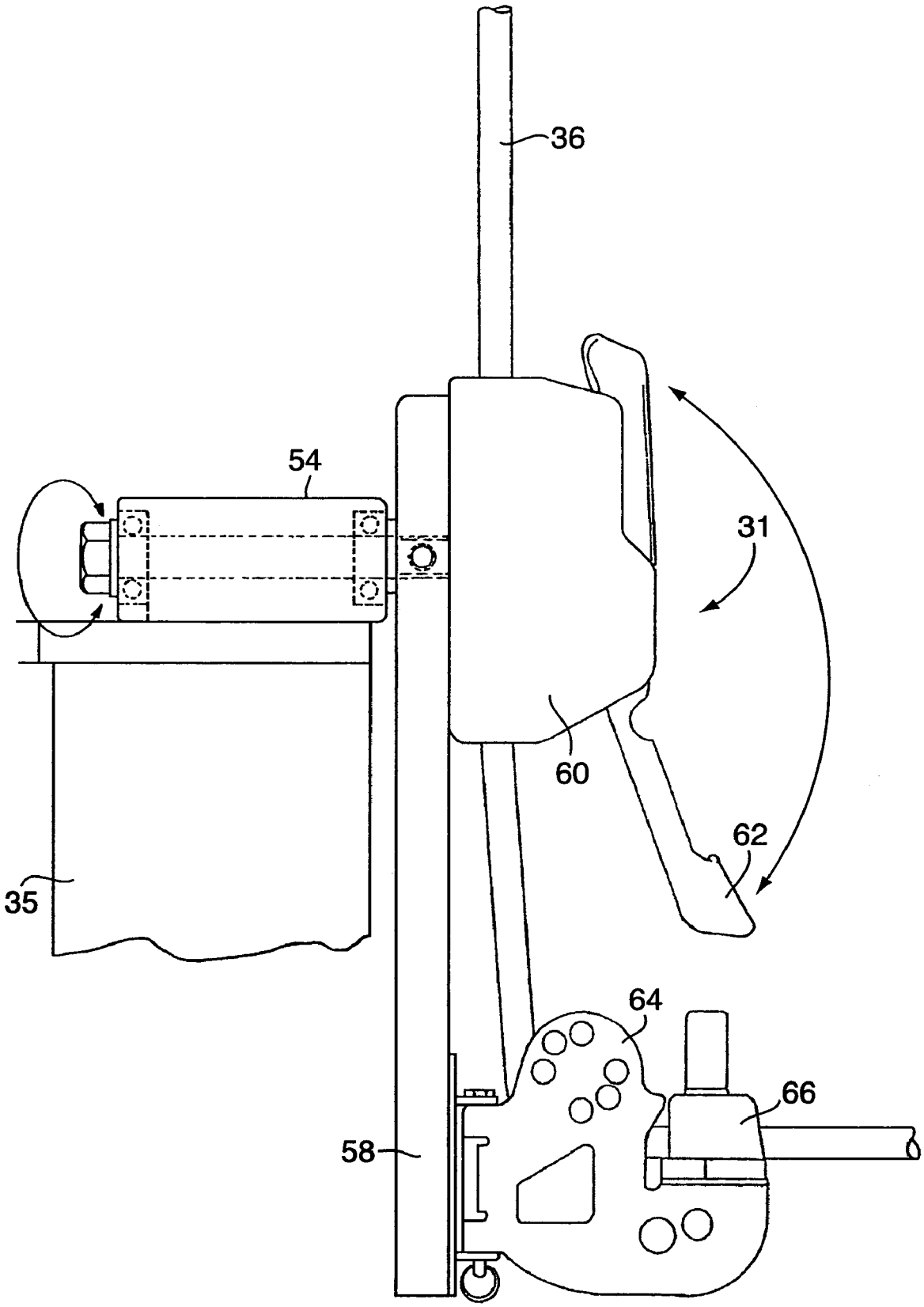
FIG. 7 is an end elevation view of the rotatable cable locking device and cleat shown in FIG. 6.

Also, the cable locking systems 31, 33 rotate with the motion of the beam to keep the ropes aligned. The rotatable cable locking systems are seen in FIGS. 6 and 7. In the locked position, rope/cable/webbing moves through the pulley system as the beams move creating a pulling motion, that distance being a ratio of the distance the pulleys are mounted from the pivot point of the beam. Either or both locking mechanisms may be set for total lock, free running, or free movement down only.

Referring to FIGS. 6 and 7, the rotatable cable locking systems 31, 33 are shown in greater detail. Stationary pier 35 includes two pillow blocks 54, 56. Referring to FIG. 7 where pivot mounting is seen for locking system 31, a carrier bar 58 is rotatably mounted in pillow block 54. Disposed on carrier bar 58 is a releasable unidirectional rope clutch 60 operated by a hand lever 62. Depending on the position of lever 62, the cable is totally locked, or may be pulled to retract the upper harness. Disposed on the lower ends of carrier bar 58 is a block and cleat similar to that used for the sheet of a sailboat. A pulley 64 and pinch cleat 66 hold one end of cable or rope 36. The other end is attached to one side of upper harness 44. Thus a redundant locking system is provided for safety of the patient.

The other locking system 33 is constructed in the same manner to hold one end of rope or cable 37. The other end is attached to a carbiner 40 on one side of lower harness 46.

A duplicate set of locking systems (not shown) is rotatably mounted on the other side of the chassis on the stationary pier 35. These hold the ends of cables or ropes attached to the opposite sides of the respective upper and lower harnesses.

The cable pulley system of block and tackle devices 32, 34 provides rapid adjustment of the harness in any position and any body shape as well as readjustment for toileting and standing-sitting quick release. The cable pulley system creates additional pulling motion in conjunction with rotary beam motion to create ergonomically correct pulling lifting ratios critical to patient care and comfort. The upper harness must pull at a slower rate than the lower pelvic harness so as not to create loading in the axillary region, and to lift the pelvis so as to straighten the body as the patient is lifted to a standing position.

While there has been described what is considered to be the preferred embodiment of the invention, other modifications will occur to those skilled in the art. It is desired to cover in the appended claims all such modifications as fall within the true spirit and scope of the invention.

What is claimed is:

1. A sit to stand support apparatus, for raising a patient from a sitting to an upright position, comprising:

a rollable chassis, at least one vertically extending support pier disposed on top of said chassis, at least one vertically extendable driving pier disposed on top of said chassis and having a roller platform thereon, means for selectively raising and lowering said roller platform, a boom comprising at least one beam pivotably mounted at one end thereof on said at least one support pier and extending beyond said at least one driving pier to terminate in a lifting end, said at least one beam having a roller mounted thereon arranged to roll on said roller platform when the roller platform is raised and lowered so as to raise and lower said lifting end, a block and tackle device having at least one block disposed on said lifting end of said at least one beam and having at least one cable with at least one cable end depending therefrom, and a harness connectable to said at least one cable end and adapted to partially support said patient.

2. The combination according to claim 1, wherein said boom comprises a pair of said beams, a pair of said support piers, a pair of said driving piers, and a pair of said block and tackle devices, said pairs being laterally spaced on said chassis.

3. The combination according to claim 1, and further including a knee pad disposed on said chassis arranged to engage the knees of said patient to provide leverage to move from a sitting to a standing position.

4. The combination according to claim 3, wherein said kneepad is movable to and from said chassis to enable the patient to ambulate.

5. The combination according to claim 1, and further including a foot tray disposed to enable said patient to place its feet on the tray when the patient is lifted and positioned on and against the sit to stand apparatus.

6. The combination according to claim 5, wherein said foot tray is slidable into said chassis to enable the patient to ambulate with the rollable chassis.

7. The combination according to claim 1, wherein said block and tackle device further includes a cable locking system rotatably mounted on said chassis having means for selectively locking the other end of said at least one cable.

8. The combination according to claim 7, wherein said cable locking system is rotatably mounted to keep said at least one cable aligned as the lifting end of the beam is raised and lowered.

9. The combination according to claim 1, and further including an additional block mounted on said at least one beam between said roller and said pivotably mounted end of said at least one beam.

10. A sit to stand support apparatus, for raising a patient from a sitting to an upright position, comprising:

a rollable chassis, at least one vertically extending support pier disposed on top of said chassis, at least one vertically extendable driving pier disposed on top of said chassis and having a roller platform thereon, means for selectively raising and lowering said roller platform, a boom comprising at least one beam pivotably mounted at one end thereof on said at least one support pier and extending beyond said at least one driving pier to terminate in a lifting end, said at least one beam having a roller mounted thereon arranged to roll on said roller platform when the roller platform is raised and lowered so as to raise and lower said lifting end, a first block and tackle device having at least a first block disposed on said lifting end of said at least one beam and having a first cable with a first cable end depending therefrom, a second block and tackle device having at least a second block disposed on said lifting end of said at least one beam and having a second cable with a second cable end depending therefrom, an upper harness connectable to said first cable end and adapted to support the axillary area of said patient, and a lower harness connectable to said second cable end and adapted to support the pelvis of said patient.

11. The combination according to claim 10, wherein said boom comprises a pair of said beams, a pair of said support piers, a pair of said driving piers, and a pair of said block and tackle devices, said pairs being laterally spaced on said chassis.

12. The combination according to claim 10, and further including a knee pad disposed on said chassis arranged to engage the knees of said patient to provide leverage to move from a sitting to a standing position.

13. The combination according to claim 12, wherein said kneepad is movable to and from said chassis to enable the patient to ambulate.

14. The combination according to claim 10, and further including a foot tray disposed to enable said patient to place its feet on the tray when the patient is lifted and positioned on and against the sit to stand apparatus.

15. The combination according to claim 14, wherein said foot tray is slidable into said chassis to enable the patient to ambulate with the rollable chassis.

16. The combination according to claim 10, wherein said block and tackle device further includes a cable locking system rotatably mounted on said chassis having means for selectively locking the other end of said at least one cable.

17. The combination according to claim 16, wherein said cable locking system is rotatably mounted to keep said at least one cable aligned as the lifting end of the beam is raised and lowered.

18. The combination according to claim 10, and further including an additional block mounted on said at least one beam between said roller and said pivotably mounted end of said at least one beam.

* * * * *